US005917154A

United States Patent [19]

Mortier

[11] Patent Number: 5,917,154

[45] Date of Patent: Jun. 29, 1999

[54] SMALL-MARGIN FLAT CABLE

[75] Inventor: Christian Mortier, Montmirail, France

[73] Assignee: Axon' Cable S.A., Montmirail, France

[21] Appl. No.: 08/645,146

[22] Filed: May 13, 1996

[30] Foreign Application Priority Data

Dec. 8, 1995 [FR] France ..... 95 14548

[51] Int. Cl.[6] ..... H01B 7/08

[52] U.S. Cl. ..... 174/117 FF; 174/117 AS; 174/117 A

[58] Field of Search ..... 174/117 F, 117 R, 174/117 FF, 117 AS, 117 A, 36; 156/55, 56

[56] References Cited

U.S. PATENT DOCUMENTS

| | | | |
|---|---|---|---|
| 3,382,118 | 5/1968 | Stanback | 156/54 |
| 4,406,914 | 9/1983 | Kincaid | 174/117 FF X |
| 4,468,089 | 8/1984 | Brorein | 350/96.23 X |
| 5,030,794 | 7/1991 | Schell et al. | 174/36 |
| 5,144,098 | 9/1992 | VanDeusen | 174/36 |
| 5,262,590 | 11/1993 | Lia | 174/36 |
| 5,268,531 | 12/1993 | Nguyen et al. | 174/36 |
| 5,306,869 | 4/1994 | Springer et al. | 174/36 |
| 5,389,741 | 2/1995 | Ueno | 174/117 F |
| 5,502,287 | 3/1996 | Nguyen | 174/113 R X |
| 5,532,429 | 7/1996 | Dickerson et al. | 174/36 |

FOREIGN PATENT DOCUMENTS 0 457 424 11/1991 European Pat. Off. .

OTHER PUBLICATIONS the "Condensed Chemical Dictionary" by Gessner G. Hawley, 1981.

European Search Report from European patent application dated Feb. 24, 1997.

*Primary Examiner*—Kristine Kincaid
*Assistant Examiner*—Chau N. Nguyen
*Attorney, Agent, or Firm*—Wolf, Greenfield & Sacks, P.C.

[57] ABSTRACT

The invention relates to a flat cable including at least one longitudinal conductor interposed between at least two layers of an insulating material and optionally of a screening material; wherein the layers are constituted by longitudinal folds around the conductor of one or more thicknesses of at least one lining tape made at least in part of a thermostable material and coated on at least its inside face with a hot-melt adhesive.

25 Claims, 3 Drawing Sheets

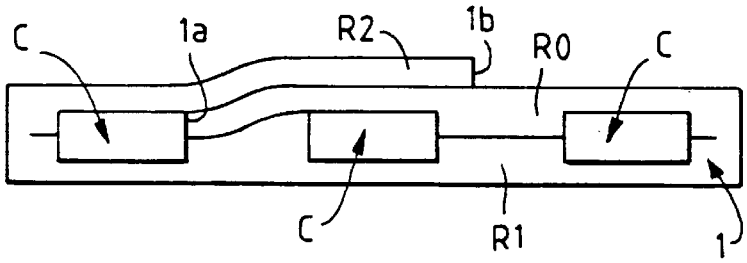
FIG.1
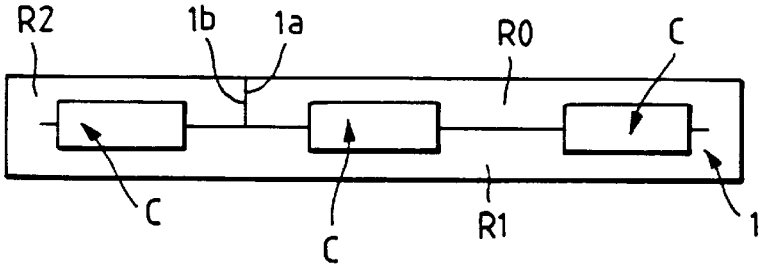
FIG.2
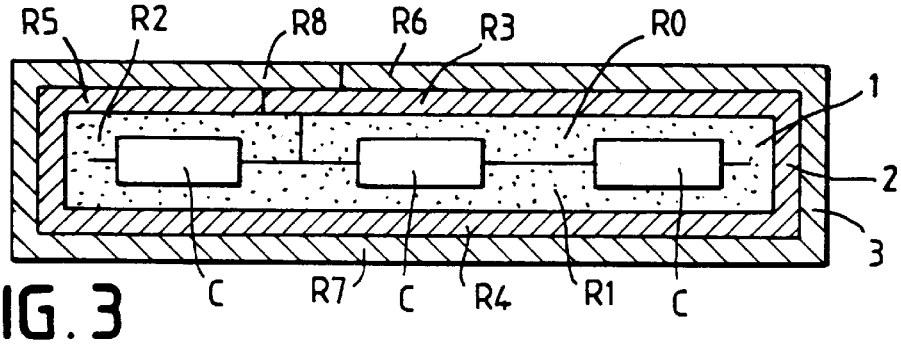
FIG.3
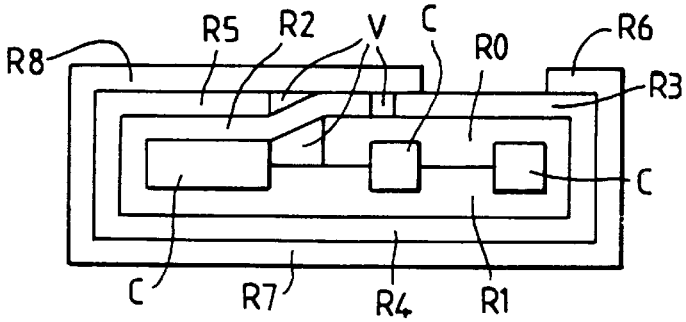
FIG.4
FIG.5
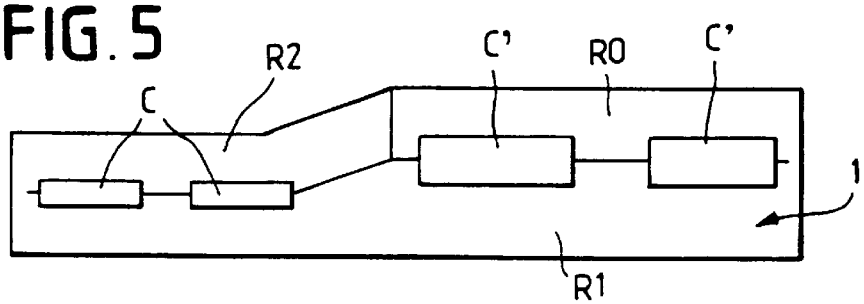

SMALL-MARGIN FLAT CABLE

The present invention relates to a flat cable.

BACKGROUND OF THE INVENTION

In general, and in a manner known per se, flat cables comprise at least one longitudinal conductor interposed between at least two layers of insulating material, possibly together with screening material.

Flat cables are widely used in the electronics industry and in computing.

The technique of manufacturing ribbon cables by extrusion or by extrusion and rolling serves to hold conductors together by means of molten material which is subsequently cooled.

There also exist rolled flat-conductor flat cables which result from said conductors being encapsulated between two laminated films, generally made up of a thermostable thermoplastic layer for providing mechanical properties and electrical properties to the cable, and one or more thermoplastic layers that provide adhesion when subjected to heat and pressure.

Depending on circumstances, various other layers can be included in the laminate, either to provide better adhesion between the two above-mentioned films and/or to provide better adhesion relative to the encapsulated conductor.

The main advantage of such flat flexible cable (FFC) is lower installation costs compared with other components.

Consumer electronic goods do not necessarily require sophisticated components even though the level of inspection performed to reduce the risks of potential breakdowns is becoming more severe. In that type of market, attention is turned much more on cost which needs to be as low as possible. Naturally there are certain applications that require highly technical criteria such as flexing tests with FFCs which must withstand several million cycles.

FFCs are highly suited for such applications and have completely superseded the other techniques mentioned above.

Nevertheless, in spite of the low current or voltage that such cables can convey, the present technique for manufacturing FFCs require large margins to be used. Those margins, which are situated along both side edges of the rolled FFC, are essential for avoiding deterioration and delamination of the product in use, e.g. while flexing. They may be several tenths of a millimeter to several millimeters wide beyond the outermost conductors.

These large and essential margins suffer from various other drawbacks, and in particular:

- a tolerance inherent to the necessary margins and due to the method;
- a large total width relative to extruded ribbon cables;
- greater volume occupied because of the width; and
- limited mechanical strength of the margins, in particular in the event of rubbing against other parts (limited resistance to abrasion, poor resistance to tearing, risk of delamination, etc.).

It is clear that such margins which are necessary in the manufacture of those products constitute a real handicap, particularly in highly technical applications. For example, merely using a cable that is moving in a housing whose tolerances match the dimensions of the cable it contains requires account to be taken both of the maximum tolerance on the cable and also of a maximum tolerance for the housing. This means that with minimum dimensions for the cable and maximum dimensions for the housing, the resulting very large clearance can give rise to premature wear of the cable and of the housing and can also give rise to noise generated by vibration, if any.

Area can also be a problem. The margins required for manufacturing FFCs occupy area that would otherwise contain one or even two conductors could have been installed instead of the margins if it were possible to eliminate the margins.

In addition, in an environment where electromagnetic wave phenomena can disturb the signals emitted, FFC cables are not immune. If the margins were smaller, then the screening placed around such FFCs would be of smaller width and would therefore be less expensive.

Also, the various mechanical operations performed on the cable (paying out, twisting, . . . ) can give rise to transverse offsets between the two films that imprison the conductors. Such offsets eliminate any possibility of achieving accurate overlapping alignment in partially stripped zones previously formed on each of the encapsulation films, and thus make it impossible to make transverse connections to the cable.

In addition, screening traditional flat cables suffers from still further difficulties since it is necessary to connect the screening layer (copper braid, sheet of aluminum-coated polyester, . . . ) to ground, e.g. by soldering it to one of the conductors.

OBJECTS AND SUMMARY OF THE INVENTION

An object of the present invention is to solve the above technical and economic problems.

According to the invention, this object is achieved by a flat cable comprising at least one longitudinal conductor interposed between at least two layers of an insulating material and optionally of a screening material;

wherein said layers are constituted by longitudinal folds around the conductor of one or more thicknesses of at least one lining tape made at least in part of a thermostable material and coated on at least its inside face in a hot-melt adhesive.

The term "thermostable material" is used to mean a material which has been stretched in two directions and which consequently possesses great thermal stability.

The hot-melt adhesive is a substance which, in addition to having adhesive properties, has a melting temperature that is lower than that of the thermostable strip which constitutes its support or backing.

According to an advantageous characteristic, said lining tape is coated in adhesive on both faces. The thickness of adhesive may, where appropriate, vary over the tape so as to modify the thickness of the cable locally or so as to create zones that are prepared for stripping.

In a variant embodiment, the longitudinal folds are formed, at least along the side edges, by the tape being folded back into itself, thereby imprisoning the conductor in the center of the cable.

In another variant, the longitudinal folds are formed by folding independent lengths of a plurality of tapes, possibly of different kinds.

According to yet another characteristic, the lining tape is in a single piece and, prior to folding, it carries the conductor on a side end zone.

In a particular embodiment, the lining tape comprises a substrate of insulating material having a strip of screening material fixed on the inside face thereof prior to folding.

In addition, provision may be made for the screening strip, after folding, to be in contact with one of the conductors.

Also, said layers locally include cavities or gaps laying the conductors and/or the screening bare for the purpose of making a connection transversely to the conductors without cutting or stripping the cable.

In another variant embodiment, the side end edges of the tape are fixed to touch each other.

In another variant, said tape is of thickness that varies across its width.

Preferably, the thermostable material is selected from the group constituted by: thermostable polyesters; terephthalates; polyolefins; polyimides; polyetherketone; polyetheretherketone; polyphenilene sulfide; polysulfone; and polyetherimide.

Also, the hot-melt adhesive is preferably selected from the group constituted by: styrene polymers; polyolefins; terephthalates; cellulose polymers; polyamides; methacrylate; polyvinylchloride (PVC); thermoplastic elastomers (TPE); polyurethane (PU); polyethylene terephthalate (PET); and polybutylene terephthalate (PBT).

The screening material is aluminum or pure copper or a metal-coated polyester, or indeed a laminate made of an insulating film and a conducting foil.

The invention also provides a method of manufacturing a flat cable, wherein:

an insulating substrate is made first out of a thermostable material;

at least one face of said substrate is coated in a hot-melt adhesive; and then a lining tape is prepared by fixing at least one longitudinal conductor on a side end edge zone of the insulating substrate optionally together with a screening strip at a distance therefrom and on the same face;

thereafter the tape is folded back onto itself successively, starting from the conductor zone, so as to form at least two insulating layers together optionally with two screening layers, with the conductor being imprisoned therebetween; and the folded tape is hot-rolled.

According to an advantageous characteristic of the invention, the screening strip is fixed to the insulating substrate at a determined distance from the nearest conductor so as to ensure that folding establishes longitudinal contact between said strip and one of the conductors.

In a variant, a thickness of material having a low dielectric constant is fixed on at least one face of the screening strip.

According to another characteristic, the longitudinal end edge of the insulating substrate is cut out so as to lay bare on the tape, the respective longitudinal ends of the conductors and of the screening strip, at least in part.

This disposition makes it possible to make a ground return by connecting the periphery of the screening strip to an end connector.

In the cable of the invention, the margins are reduced at minimum to the thickness of the tape, and that is very small. Consequently, there is no risk of the side edges of the cable delaminating as is the case when traditional flat cables are subjected to mechanical stresses or to thermal shock.

When the end edges of the tape are disposed so as to touch, the forces produced by repetitive flexing applied to the cable do not act in the adhesive zone, thereby improving the resistance of the cable to flexing, and thus improving its lifetime.

In addition, since each layer is constituted by a longitudinal fold of a single length of tape, it becomes possible to make partially stripped zones overlying each other on opposite faces of the cable and without any positioning offset. Consequently, it is easy to make partial transverse connections.

Also, it is possible to obtain very good dielectric properties for the cable by making it very thick by having several folds of the tape around the conductor(s).

The cable of the invention is easy to make and its structure is more homogenous and more compact than that of traditional flat cables.

BRIEF DESCRIPTION OF THE DRAWINGS

The invention will be better understood on reading the following description accompanied by the drawings, in which:

FIG. 1 is a diagrammatic cross-section view of a first embodiment of the cable of the invention;

FIGS. 2, 3, 4, and 5 are diagrammatic views of other embodiments of the cable of the invention;

MORE DETAILED DESCRIPTION

Figure 6A:
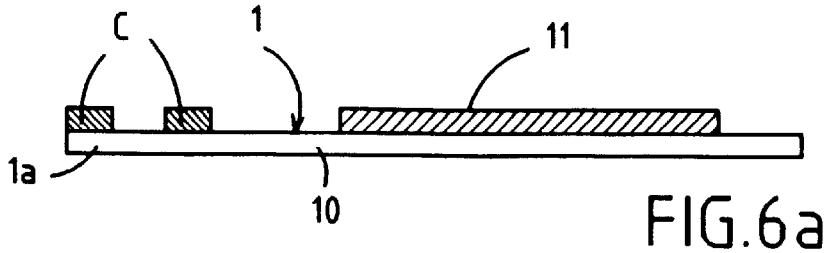
FIGS. 6*a* and 6*b* are respectively an end view and a plan view of an embodiment of the lining tape of the invention prior to folding.

In general, the flat cable of the invention includes at least one, and in the embodiment shown by way of example in FIGS. 1 to 5, three longitudinal conductors C interposed between at least two layers of insulating material. The insulating layers are constituted by longitudinal folds $R_0$, $R_1$, $R_2$, . . . around the conductors C of a tape 1 of lining material made, at least in part, on a substrate of thermostable material. Prior to folding, the substrate is coated at least on its inside face with a hot-melt adhesive.

The longitudinal folds $R_0$, $R_1$, . . . of the tape 1 thus form one or more thicknesses of insulating material around the conductors C.

The thermostable material is preferably selected from the group constituted by: thermostable polyesters; terephthalates; polyolefins; polyimides; polyetherketone; polyetheretherketone; polyphenylene sulfide; polysulfone; and polyetherimide.

The adhesive is preferably selected from the group constituted by: styrene polymers; polyolefins, terephthalates; polyamides; methacrylates and cellulose polymers; polyvinylchloride (PVC); thermoplastic elastomers (TPE); polyurethane (PU); polyethylene terephthalate (PET); and polybutylene terephthalate (PBT). By way of example, the adhesive may be applied to the substrate in form of a liquid or a hot gel that results from prior melting of a granulate.

In the embodiment of FIG. 1, the folds $R_0$, $R_1$, and $R_2$ are made, at least along the side edges, by folding the tape 1 back onto itself, thereby imprisoning the conductors in the center of the cable. The free edge of the outer side end 1*b* of the tape 1 is fixed to the base fold $R_0$. The free edge of the inner side end 1*a* of the tape 1 is fixed, for example in contact with the side conductor C.

In this case, the thickness of the flat cable is not uniform, but a larger area of adhesive is available. The insulating layers formed by the folds $R_0$, $R_1$, and $R_2$ are locally provided, where appropriate, with gaps or cavities forming corresponding zones for laying bare the conductors, and enabling transverse connections to be made to all, or some only, of the conductors without it being necessary to cut the cable and without any risk of offsetting.

In the embodiment of FIG. 2, the free edges 1*a* and 1*b* of the side ends, respectively of the fold $R_0$ and of the fold $R_2$ of the tape 1 are fixed so as to touch each other, thereby enabling uniform thickness and a better finish to be obtained.

In the embodiment of FIG. 3, the flat cable has a plurality of longitudinal folds formed in independent lengths of predetermined widths of a plurality of tapes 1, 2, and 3 of different kinds. Where appropriate, it is thus possible to provide composite coating for the conductors C, by using different insulating materials for each fold.

The end edges of each folded-back fold are likewise touching in this case, which means that the superposed tapes 1, 2, and 3 need to be of increasing width. In addition, the respective thicknesses of each of the tapes 1, 2, and 3 may be different. Optionally, the tapes 1, 2, and 3 could be coated in adhesive on both faces so as to reinforce bonding between the layers.

Naturally, when it is desired to use distinct tapes of equal width, the lateral end edges 1*a*, 1*b* of the folds cannot touch each other for all of the layers, given the progressive increase in thickness.

Under such conditions, it is necessary initially to determine the single width of the tapes such that each layer completely overlies the layer situated immediately beneath it, as shown in FIG. 4. In the embodiment shown in this figure, there remain voids V in the various layers, which voids may optionally be filled with adhesive.

The voids V occur because the single width of the tapes is insufficient for the ends of the folds $R_3$, $R_5$ to be meet or for the ends of the folds $R_6$, $R_8$ to meet.

In this case, only the ends of folds $R_0$ and $R_2$ overlap and the end of fold $R_2$ is fixed facing the end of fold $R_3$.

In the embodiment of FIG. 5, the flat cable has four conductors. The dimensions of the conductors C are different from those of the conductors C', such that it is preferable to use a tape 1 whose thickness is not uniform, but varies across its width, or else to use a tape of uniform thickness but having a coating of adhesive that is of varying thickness.

FIGS. 6*a*, 6*b* and 8*a*, 8*b* show the lining tape 1 before folding.

The method of manufacturing a screened cable of the invention is described below with reference to FIGS. 6*a*, 6*b* et seq.

In this case, the tape 1 comprises a one-piece substrate 10 of thermostable insulating material coated on at least one face in hot-melt adhesive, as described above. The tape 1 carries two conductors C in a zone adjacent to the side end edge 1*a*. Where appropriate, the hot-melt adhesive serves to fix the conductors flat on the tape 1. Before folding, a strip 11 of screening material is fixed on the inside face of the substrate 10 (the top face in the figures). Naturally, the screening strip 11 may likewise be fixed by means of a coating of hot-melt adhesive.

The screening material is a conductor, e.g. aluminum or copper (in foil or braid form) or indeed a metalcoated polyester or a laminate comprising an insulating film and a conductive foil.

Figure 8A:
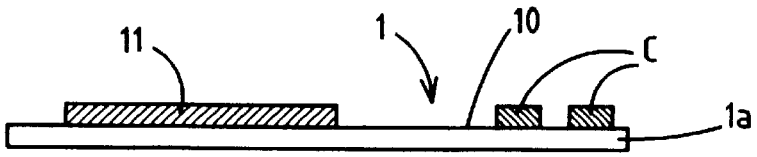
FIGS. 8*a* and 8*b* are respectively an end view and a plan view of another embodiment of the tape of the invention, prior to folding.
Figure 8B:
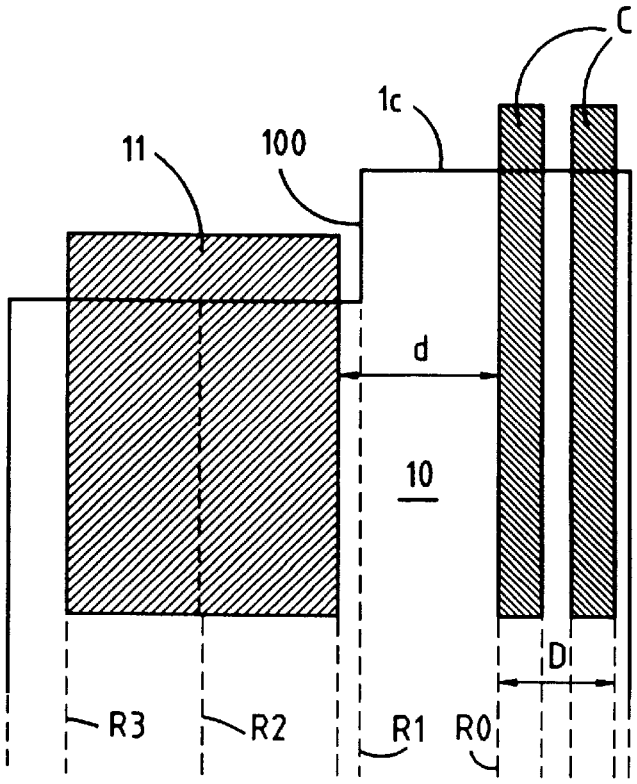

Thereafter, successive longitudinal folds $R_0$, $R_1$, $R_2$, and $R_3$ are formed by folding the tape 1 over onto itself, beginning with the zone containing the conductors C so as to form at least two insulating layers and two screening layers, with the conductors C being held captive between them. Fold lines $R_0$, $R_1$, $R_2$, and $R_3$ are shown in FIGS. 6*b* and 8*b*.

Finally, the folded tape is hot-rolled so as to make the cable flat and compact; the hot-melt coating participates both in providing cohesion between the various folds and between the folds and the conductors and/or the screening.

The rolling step is preferably formed by means of heating rollers.

Figure 6B:
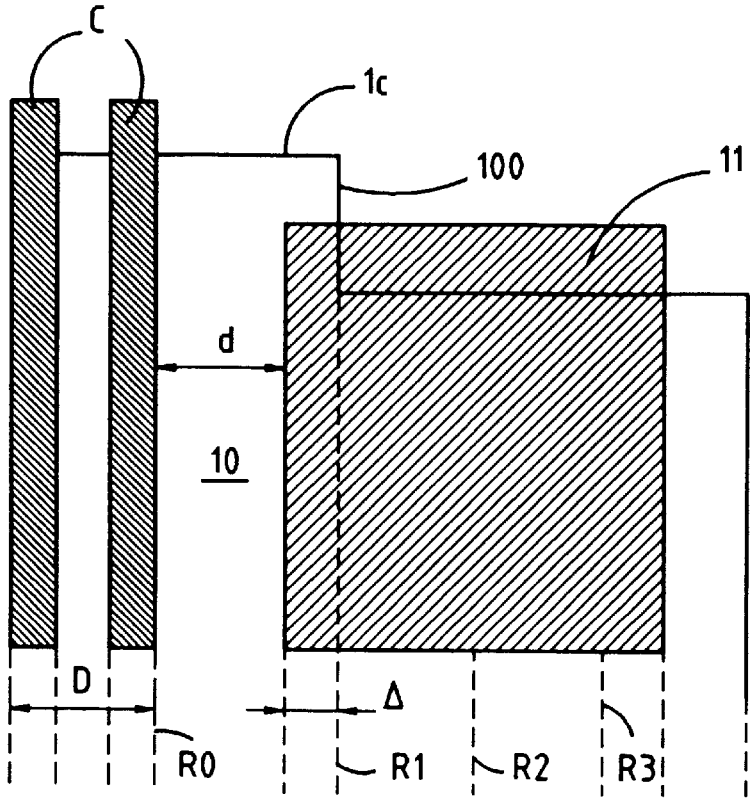
Figure 7A:
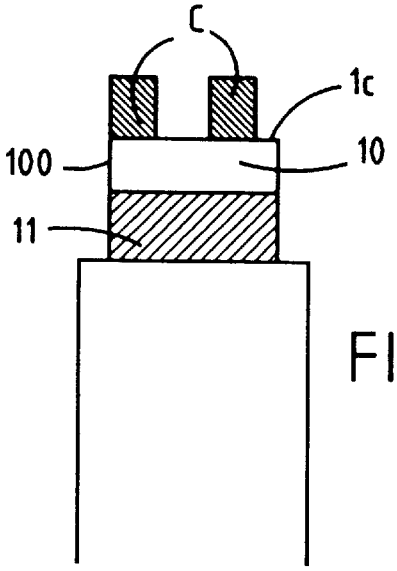
FIGS. 7*a* and 7*b* are respectively a plan view and an end view of the cable of the invention in the embodiment of FIGS. 6*a* and 6*b*, after folding.
Figure 7B:
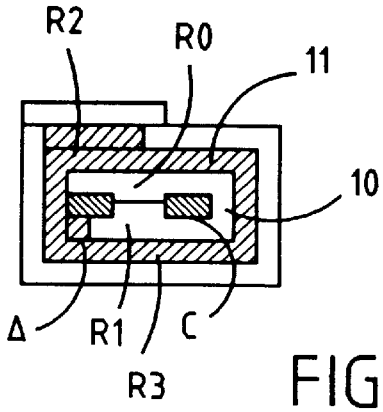

In the embodiment of FIGS. 6*a*, 6*b*, 7*a*, and 7*b*, the screening strip 11 is fixed on the substrate 10 at a determined distance d from the nearest conductor so that, on folding, longitudinal contact is established between the strip 11 and one of the conductors C, as shown on the left of FIG. 7*b*. In this case, the distance d is thus shorter than the distance D between the outer side edges of the two conductors.

The difference Δ represents the width of the zone of contact between the conductor C and the screening strip 11 as created by folding.

In FIG. 8*b*, the distance d between the screening strip 11 and the nearer conductor is greater than the distance D between the end edges of the conductors C.

Figure 9A:
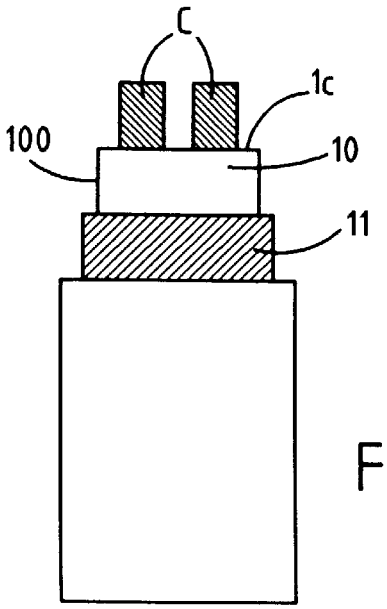
FIGS. 9*a* and 9*b* are respectively a plan view and an end view of the cable of the invention in the embodiment of FIGS. 8*a* and 8*b*, after folding.
Figure 9B:
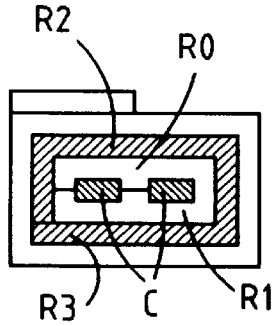

Thus, in this case there is no contact after folding between the conductors and the screening 11, as can be seen in FIG. 9*b*.

The screening 11 is thus kept separate from the conductors by the thermostable insulating material of the substrate 10.

As shown in FIGS. 6*b* and 8*b*, the longitudinal end edge 1*c* of the tape 1 has a notch 100 cut out in the insulating substrate 10 so that the respective longitudinal ends of the conductors C and the screening strip 11 are left bare, at least in part.

In a variant embodiment, not shown, a thickness of material having a low dielectric constant is fixed on at least one face of the screening strip 11 so as to obtain higher impedance or lower capacitance by moving the conductors further from the screening layer.

I claim:

1. A flat cable comprising at least one longitudinal conductor interposed between at least two layers of an insulating material;

wherein said layers include substantially flat longitudinal folds around the at least one conductor of at least open lining tape coated on at least its inside face with an adhesive, and wherein the lining tape is in a single piece and, prior to folding, it carries the at least one conductor on its side end zone, and wherein the longitudinal folds are formed by folding independent lengths of a plurality of tapes, possibly of different kinds.

2. The cable as claimed in claim 1, wherein the at least one longitudinal conductor is flat.

3. A flat cable comprising at least one longitudinal conductor interposed between at least two layers of an insulating material;

wherein said layers include substantially flat longitudinal folds around the at least one conductor of at least open lining tape coated on at least its inside face with an adhesive, wherein the lining tape is in a single piece and, prior to folding, it carries the at least one conductor on its side end zone, wherein the lining tape comprises a substrate of insulating material having a strip of screening material fixed on the inside face thereof prior to folding, and wherein the screening strip, after folding, is in contact with the at least one conductor.

4. The cable as claimed in claim 3, wherein the at least one longitudinal conductor is flat.

5. A flat cable comprising at least one longitudinal conductor interposed between at least two layers of an insulating material;

wherein said layers include substantially flat longitudinal folds around the at least one conductor of at least open lining tape coated on at least its inside face with an adhesive, wherein the lining tape is in a single piece and, prior to folding, it carries the at least one conductor on its side end zone, and wherein said layers locally include cavities or gaps leaving the at least one conductor bare for the purpose of making a connection transversely to the at least one conductor without cutting or stripping the cable.

6. The cable as claimed in claim 5, wherein the at least one longitudinal conductor is flat.

7. A flat cable comprising at least one longitudinal conductor interposed between at least two layers of an insulating material;

wherein said layers include substantially flat longitudinal folds around the at least one conductor of at least open lining tape coated on at least its inside face with an adhesive, wherein the lining tape is in a single piece and, prior to folding it carries the at least one conductor on its side end zone, wherein the at least one longitudinal conductor is interposed between at least two layers of a screening material, and wherein said layers of the insulating material locally include cavities or gaps leaving the screening material bare for the purpose of making a connection transversely to the at least one conductor without cutting or stripping the cable.

8. The cable as claimed in claim 7, wherein the at least one longitudinal conductor is flat.

9. A flat cable comprising at least one longitudinal conductor interposed between at least two layers of an insulating material;

wherein said layers include longitudinal folds around the at least one conductor of at least open lining tape coated on at least its inside face with an adhesive, and wherein said tape is of a thickness that varies across a width of the cable.

10. The cable as claimed in claim 9, wherein the at least one longitudinal conductor is flat.

11. A flat cable comprising at least one longitudinal conductor interposed between at least two layers of an insulating material;

wherein said layers include longitudinal folds around the at least one conductor of at least open lining tape coated on at least its inside face with an adhesive, and wherein said adhesive is of a thickness that varies across a width of the cable.

12. A cable according to claim 11, wherein the layers include substantially flat longitudinal folds of said at least open lining tape.

13. The cable as claimed in claim 11, wherein the at least one longitudinal conductor is flat.

14. A flat cable comprising at least one longitudinal conductor interposed between at least two layers of an insulating material;

wherein said layers include longitudinal folds around the at least one conductor of at least open lining tape coated on at least its inside face with an adhesive, and wherein the lining tape is in a single piece and, prior to folding, it carries the at least one conductor directly on the adhesive on a side end zone of the tape.

15. A cable according to claim 14, wherein said lining tape is coated with adhesive on its outside face.

16. A cable according to claim 14, wherein side end free edges of the tape are fixed to touch each other.

17. A flat cable according to claim 14, wherein the lining tape comprises a thermostable material and the adhesive comprises a hot-melt adhesive.

18. A cable according to claim 17, wherein the thermostable material is selected from a group consisting of: thermostable polyesters; terephthalates; polyolefins; polyimides; polyetherketone; polyetheretherketone; polyphenilene sulfide; polysulfone; and polyetherimide.

19. A cable according to claim 17, wherein the hot-melt adhesive is selected from a group consisting of: styrene polymers; polyolefins; terephthalates; cellulose polymers; polyamides; methacrylate; polyvinylchloride; thermoplastic elastomers; polyurethane; polyethylene terephthalate; and polybutylene terephthalate.

20. The cable according to claim 14, wherein the at least one longitudinal conductor is interposed between at least two layers of a screening material.

21. A cable according to claim 14, wherein the longitudinal folds are formed, at least along side edges of the at least one conductor, by the tape being folded back onto itself, thereby imprisoning the at least one conductor in a center portion of the cable.

22. A cable according to claim 14, wherein said layers locally include cavities or gaps leaving the at least one conductor bare for the purpose of making a connection transversely to the at least one conductor without cutting or stripping the cable.

23. A cable according to claim 14, wherein the layers include substantially flat longitudinal folds of the at least open lining tape.

24. A cable according to claim 14, wherein the layers include substantially flat longitudinal folds of the at least open lining tape.

25. The cable as claimed in claim 14, wherein the at least one longitudinal conductor is flat.

* * * * *